US005351870A

United States Patent [19]

Nagel et al.

[11] Patent Number: 5,351,870

[45] Date of Patent: Oct. 4, 1994

[54] METHOD OF AND DEVICE FOR SEPARABLY CONNECTING WEBS OF PHOTOSENSITIVE MATERIAL TO A BELT CONVEYOR

[75] Inventors: Erich Nagel, Anzing; Karl-Heinz Wagner; Lothar Himmelsbach, both of Munich; Alfred Zwischenberger, Putzbrunn; Wolfgang Viehrig, Munich, all of Fed. Rep. of Germany

[73] Assignee: Agfa Gevaert Aktiengesellschaft, Leverkusen, Fed. Rep. of Germany

[21] Appl. No.: 869,191

[22] Filed: Apr. 10, 1992

Related U.S. Application Data

[63] Continuation of Ser. No. 415,176, Sep. 29, 1989, abandoned.

[30] Foreign Application Priority Data

Oct. 1, 1988 [DE] Fed. Rep. of Germany ..... 3833469

[51] Int. Cl.[5] ..... B65H 20/16; G03D 13/10

[52] U.S. Cl. ..... 226/92; 354/345

[58] Field of Search ..... 226/91, 92, 170; 354/221, 222, 345; 24/585, 237, DIG. 8, DIG. 9

[56] References Cited

U.S. PATENT DOCUMENTS

| | | | |
|---|---|---|---|
| 1,317,243 | 9/1919 | Tornsjo | 354/345 |
| 1,454,213 | 1/1921 | Chapman et al. | 354/345 |
| 4,188,108 | 1/1980 | Fulomo | 226/92 X |
| 4,330,191 | 5/1982 | Rawlings et al. | 226/92 X |
| 4,576,321 | 3/1986 | Marson | 226/92 X |
| 4,773,580 | 9/1988 | Schweiger | 354/345 X |

*Primary Examiner*—Daniel P. Stodola
*Attorney, Agent, or Firm*—Darby & Darby

[57] ABSTRACT

A one-piece clip of flexible metallic plastic material has a first section which can be separably affixed to a belt conveyor, and an elongated slotted second section. A web of photosensitive material is caused to extend through the slot of the second section so that its leader is located at one side and the next-following portion of the web is located at the other side of the slot. The leader is then folded against the respective major surface of the second section, and the web is form-lockingly connected to the second section. The form-locking connection can be established by one or more pairs of complementary tooth-shaped protuberances which extend into the slot and penetrate into and through the folded portion of the web behind the leader, by securing the leader to the next-following portion of the web by a clamp in an enlarged window-like portion of the slot, or by bonding a small part of the leader to the next-following portion of the web in such window-like portion of the slot.

17 Claims, 3 Drawing Sheets

METHOD OF AND DEVICE FOR SEPARABLY CONNECTING WEBS OF PHOTOSENSITIVE MATERIAL TO A BELT CONVEYOR

This application is a continuation of application Ser. No. 07/415,176, filed Sep. 29, 1989, now abandoned.

BACKGROUND OF THE INVENTION

The invention relates to improvements in devices for transmitting motion to flexible webs, for example, to webs of photosensitive material which must be transported through a developing machine. The invention also relates to a method of transporting webs with a conveyor, particularly with an endless belt conveyor.

Commonly owned U.S. Pat. No. 4,773,580 to Schweiger discloses a device which is used to transmit motion to elongated flexible webs and which can be used with advantage for attachment to a belt conveyor in order to transport webs of photographic paper or the like through successive liquid baths in a developing machine. The patented device has a frame-like first section which can be separably connected to a belt conveyor, and an elongated second section in the form of a flat arm having a longitudinally extending slot for the web which is to be entrained by the conveyor. The web is caused to pass through the slot so that the leader is located at one side and the next-following portion of the web is located at the other side of the slot. In the next step, the device is turned about an axis extending longitudinally of the slot so that the web is convoluted around the arm to thus ensure that the connection between the arm and the web will suffice to pull a relatively long web through the developing machine. The turning step entails that the leader is confined between the next-following portion of the web and the arm so that the web defines an elongated pocket which is open at its ends but is closed all the way along the slot. The pocket is filled with liquid when the web is caused to advance through the liquid baths in a developing machine. The last bath normally contains a supply of water for the purpose of rinsing successive increments of the advancing web before the web enters a drying chamber. The liquid which gathers in the pocket is not entirely evaporated in the drying chamber so that, when the device is thereupon detached from the conveyor, normally abruptly, droplets of water which remained in the pocket at the leading end of the web trickle along the web and remain on the web at the time the latter is convoluted onto a reel or spool. The droplets are caused to spread out between the convolutions of the web and form pools which bond the neighboring surfaces of convolutions to each other. When the web is removed from the reel, the bonds between abutting surfaces of neighboring convolutions are destroyed with attendant damage to the material of the web. If the liquid is permitted to penetrate all the way to the developed images on a web of photographic paper, the images are destroyed and the respective film frames must be copied again.

OBJECTS OF THE INVENTION

An object of the invention is to provide a novel and improved method of transporting webs of photographic paper or the like in such a way that the leaders of the webs cannot form substantially closed pockets which would be likely to retain liquid when the leaders of the webs emerge from liquid baths.

Another object of the invention is to provide a novel and improved method of separably affixing the leader of a flexible web to a device, such as a clip, which is connectable to a conveyor for transport of the web along a predetermined path, for example, in a photographic developing machine.

A further object of the invention is to provide a method which renders it possible to properly develop, demoisturize and otherwise treat webs of photosensitive material all the way to the leaders of such webs.

An additional object of the invention is to provide a novel and improved method of separably affixing the leader of a web to the slotted arm of a clip similar to that which is disclosed in commonly owned U.S. Pat. No. 4,773,580.

Still another object of the invention is to provide a novel and improved device which can be used to separably attach the leader of a web to a conveyor for transport of the web along a predetermined path.

A further object of the invention is to provide the device with novel and improved means for separably but reliably connecting its arm to the leader of a web of flexible material.

An additional object of the invention is to provide the device with novel and improved means for promoting the discharge of liquid which contacts the device during transport through one or more liquid baths.

Another object of the invention is to provide the device with novel and improved means for preventing excessive contact between the leader of a web and the arm.

A further object of the invention is to provide a simple, compact and inexpensive device which can be used as a superior substitute for heretofore known devices and which can be separably connected with existing conveyors in photographic developing and other machines.

SUMMARY OF THE INVENTION

One feature of the present invention resides in the provision of a method of separably affixing the leader of a flexible web (such as a web of photographic paper or the like) to a slotted motion transmitting arm forming part of a clip which is connectable to a conveyor, particularly to an endless belt conveyor. The method comprises the steps of inserting the web into the slot of the arm so that the leader is located at one side and the next-following portion of the web is located at the other side of the slot, folding the web in the region of the slot so that the leader and the next-following portion of the web make an angle of less than 180°, preferably an angle of less than 90°, and establishing a form-locking connection between the web and the arm in the region of the slot. The aforementioned angle can equal or approximate 0°.

In accordance with one presently preferred embodiment of the method, the connection establishing step comprises providing the arm with at least one protuberance at the slot, and effecting penetration of the protuberance into the web in the region where the leader is flexed relative to the next-following portion of the web. Such connection establishing step can comprise providing the arm with at least one pair of complementary protuberances which extend transversely of the slot, and effecting penetration of at least one protuberance into and through the web in the region where the leader is flexed relative to the next-following portion of the web.

In accordance with another presently preferred embodiment of the method, the connection establishing step includes attaching the leader to the next-following portion of the web in or close to the slot. Such method preferably further comprises the step of providing the arm with a window which communicates with the slot, and the attaching step then comprises fixedly securing the leader to the next-following portion of the web within the window. The attaching step can include clamping the leader to the next-following portion of the web or bonding the leader to the next-following portion of the web.

The folding operation is preferably carried out in such a way that the length of the folded leader (as seen in the longitudinal direction of the web, is not more than one-half the width of the web.

Folding of the leader relative to the next-following portion of the web preferably involves the making of a single pocket which extends longitudinally of the web. The pocket is open because the next-following portion of the web is not convoluted around the leader, and this facilitates the outflow of water or any other liquid which happens to penetrate into the pocket while the web is conveyed through a developing machine if the web is made of photosensitive material, such as photographic paper, which requires development by passing through a series of successive liquid baths.

Another feature of the present invention resides in the provision of a device (such as a clip made of a metallic or plastic material) which is used to transmit motion from a conveyor (e.g., an endless belt conveyor) to the leader of a flexible web, such as a web of photographic material. The improved device comprises a first section (e.g., a frame-like part of the clip) which is separably connectable with the conveyor, and a second section (preferably in the form of an elongated flat arm) having an elongated slot serving to receive a web so that the leader of the web is located at one side and the next-following portion of the web is located at the other side of the slot and the next-following portion makes with the leader an angle of normally less than 90°. The improved device further comprises means for form-lockingly connecting the web to the second section in the region of the slot.

In accordance with one presently preferred embodiment, the connection comprises at least one protuberance which is provided on the second section and extends transversely of the slot to penetrate into the web in the region where the leader is integral with the next-following portion of the web. The second section can comprise at least one pair of complementary protuberances which are disposed opposite each other and extend transversely of the slot so as to penetrate into and through the web in the region where the leader is integral with the next-following portion of the web. At least one of the protuberances can resemble or constitute a pyramid with a preferably sharp tip which is received in a socket of the other protuberance. The connecting means can comprise two pairs of complementary protuberances, and each such pair is nearer to a different end of the slot. The arrangement is preferably such that the pairs of protuberances are spaced apart from the respective ends of the slot a distance between substantially one-fourth and one-third of the overall length of the slot. Such length can slightly exceed the width of the web.

In accordance with another presently preferred embodiment of the improved device, the second section has at least one window which communicates with the slot, and the connecting means comprises means for attaching the leader to the next-following portion of the web in the window so that the leader cannot return into the plane of the next-following portion of the web. The second section includes two parts which flank the slot, and the window preferably includes a first portion in one part and a second portion in the other part of the second section. The means for attaching the leader to the next-following portion of the web in the window can include a clamp (e.g., a clamp of the type customarily employed in staplers) or a portion of the leader which is bonded (e.g., welded or adhesively secured) to the next-following portion of the web.

As mentioned above, the second section can include or constitute a flat elongated arm with two major surfaces and with two edge faces which alternate with the major surfaces. The slot extends between the two major surfaces of the arm. At least one of the edge faces can be inclined with reference to the slot to enhance the flow of liquid (if any) from the pocket between the leader and the next-following portion of the web. The width of at least a portion of the arm can increase or decrease in a direction toward the first section. Alternatively, the width of a first portion of the arm can increase toward and the width of a second portion of the arm can decrease in a direction away from the first section. The arm can define at least one longitudinally extending relatively sharp edge, e.g., an elongated edge in the region of each of the two edge faces.

The novel features which are considered as characteristic of the invention are set forth in particular in the appended claims. The improved motion transmitting device itself, however, both as to its construction and the mode of using the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
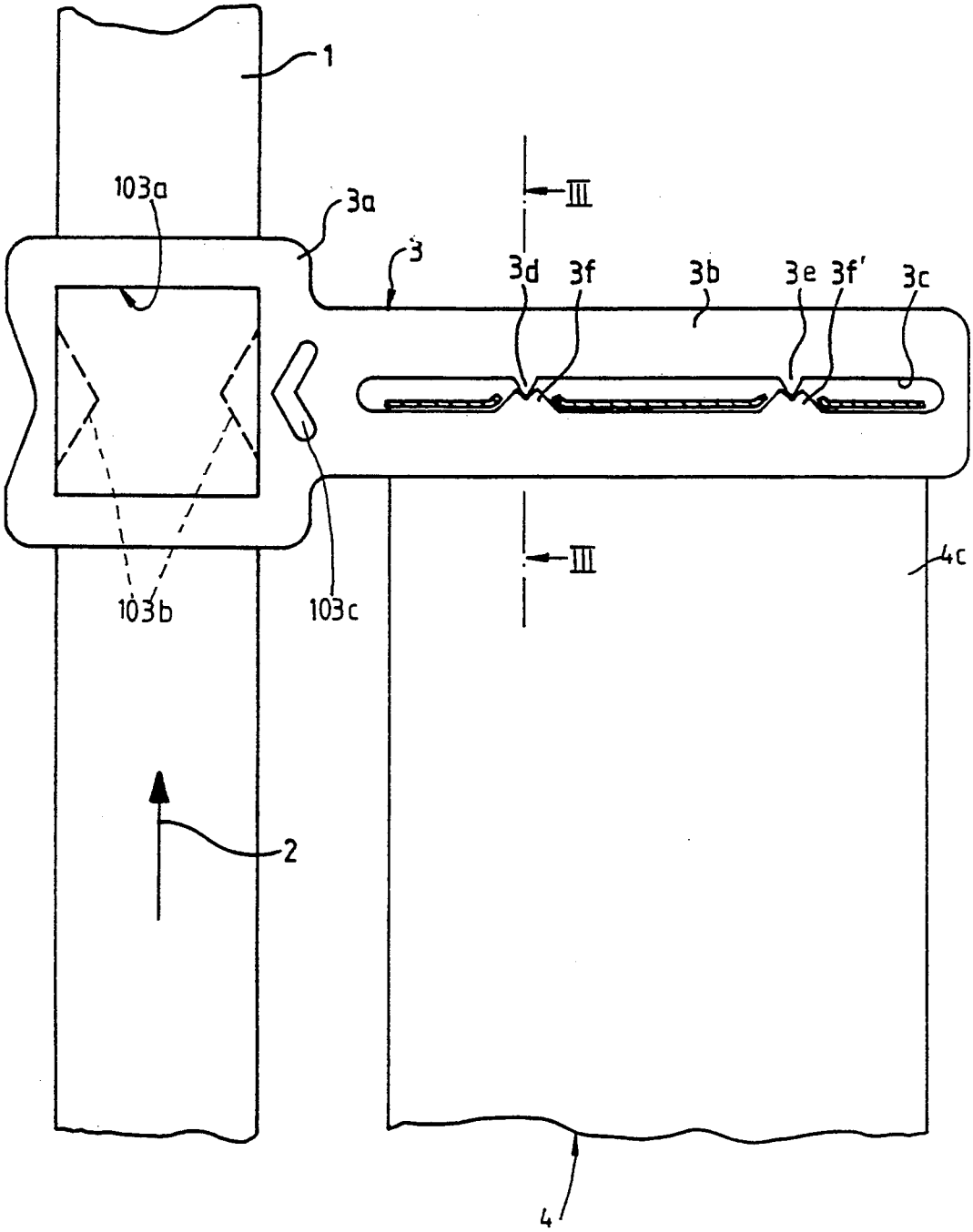
FIG. 1 is an elevational view of a motion transmitting device which embodies one form of the invention, the first section of the device being separably connected to a belt conveyor and the second section of the device being connected with a web of flexible material in accordance with one embodiment of the method.

FIG. 1 shows a portion of an elastic belt conveyor 1 which can be driven to advance in the direction of arrow 2 and to thereby entrain an elongated flexible web 4, e.g., a web of photographic paper which is to be advanced through a series of liquid baths in a photographic developing machine. To this end, the conveyor 1 is separably connected with the web 4 by a motion transmitting device or clip 3. The latter comprises a first section or frame 3*a* which can be separably connected with a selected portion of the conveyor 1, preferably in a manner as fully disclosed in commonly owned U.S. Pat. No. 4,773,580 which is incorporated herein by reference. As shown, the section 3*a* defines a square or rectangular window 103*a* and has two triangular projections 103*b* which extend into the window at the marginal portions of the conveyor 1. The conveyor extends into the window 103*a* from behind the section 3*a* (as seen in FIG. 1), thereupon overlies the projections 103*b* (i.e., it extends in front of these projections) and leaves the window 103*a* to extend behind the top horizontal part of the section 3*a*. The width of the window 103*a* is slightly less than the width of the conveyor 1. A cutout 103*c* in the region between the section 3*a* and an elongated flat am-shaped second section 3*b* of the clip 3 enhances the flexibility of the clip. The manner in which the conveyor 1 is trained over a plurality of pulleys and/or other deflecting and guiding elements on its way through the developing machine forms no part of the invention. The utilization of such conveyors in conjunction with developing machines for photographic materials is well known in the relevant art. The path for the conveyor 1 can extend through a developing bath, thereupon through a fixing bath, then through a rinsing bath and thereafter through a drying chamber. As a rule, the conveyor 1 is made of a suitable elastic plastic material and is caused to advance along an endless path.

The projections 103*b* of the first section 3*a* of the clip 3 ensure that the conveyor 1 includes portions in different planes, namely in a plane in front of and in a plane behind the section 3*a* of FIG. 1. This ensures that, unless intentionally detached, the clamp 3 will engage and remain connected to a selected portion of the conveyor 1 for advancement along the aforementioned endless path. The arrangement is such that frictional engagement between the conveyor 1 and the section 3*a* of the clip 3 is very pronounced but that the marginal portions of the conveyor are not subjected to excessive stresses.

The section or arm 3*b* is integral with the section 3*a* of the clip 3. The latter can be made of a single piece of elastically deformable plastic material and its section 3*b* is coplanar with the section 3*a*.

Figure 3:
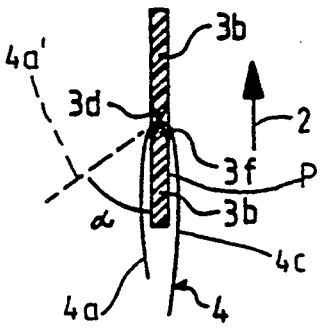
FIG. 3 is a transverse sectional view substantially as seen in the direction of arrows from the line III—III of FIG. 1.

The section 3*b* which is shown in FIGS. 1 and 3 has a constant width and is provided with an elongated longitudinally extending slot 3*c* which extends between its major surfaces and in substantial parallelism with its relatively narrow edge faces which alternate with the major surfaces.

The width of the major part of the slot 3*c* considerably exceeds (e.g., by one or more millimeters) the thickness of the web 4, and the length of the slot 3*c* exceeds (e.g., by several millimeters) the width of the web. This facilitates insertion of the web 4 into the slot 3*c* in such a way that the leader 4*a* of the web is located at one side and the next-following portion 4*c* of the web is located at the other side of the slot. This can be readily seen in FIG. 3. The length of the leader 4*a* (as seen in the longitudinal direction of the web 4) need not exceed half the width of the web and can be considerably less, e.g., one third.

Figure 2:
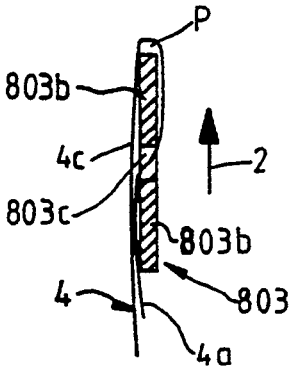
FIG. 2 (PRIOR ART)
FIG. 2 is a transverse sectional view of the second section of a conventional motion transmitting device and further shows a portion of a web which is convoluted around the second section to form a substantially sealed pocket.

In accordance with a feature of the invention, the section 3*b* of the clip 3 carries means for form-lockingly connecting the web 4 to the section 3*b* in the region of the slot 3*c* in such a way that the next-following portion 4*c* of the web need not be convoluted around the section 3*b* in a manner which is customary in connection with heretofore known clips and as shown in FIG. 2.

The improved means for form-lockingly connecting the web 4 to the section 3*b* comprises two pairs of substantially tooth-shaped protuberances 3*d*, 3*f* and 3*e*, 3*f'*. The protuberances 3*d*, 3*e* have sharp tips and preferably resemble pyramids (see FIG. 3), and the tips of the protuberances 3*f*, 3*f'* have notches or sockets for the tips of the respective protuberances 3*d*, 3*e*. The protuberances 3*d*, 3*e* are integral with the upper part of the section 3*b* (as seen in FIG. 1), and the protuberances 3*f*, 3*f'* are integral with the lower part of this section. All four protuberances extend transversely of the slot 3*c*, and the protuberances 3*f*, 3*f'* preferably also resemble pyramids to facilitate penetration of their socketed tips through the web 4 in the region where the leader 4*a* is integral with the next-following portion 4*c*. The pyramidal shape of one of the protuberances 3*f*, 3*f'* can be seen in FIG. 3; this protuberance has two sides or facets which extend at right angles to the plane of FIG. 3 and converge toward each other in a direction toward the adjacent complementary protuberance 3*d* or 3*e*.

The section 3*b* offers a pronounced resistance to flexing in its plane (i.e., in the plane of FIG. 1) but can be readily flexed in directions at right angles to such plane. This facilitates introduction of the web 4 into the slot 3*c*. For example, the median portion of the upper part of the section 3*b* can be flexed rearwardly and the median portion of the lower part of this section can be flexed forwardly to greatly increase the width of the median portion of the slot 3*c* preparatory to insertion of the web 4 in such a way that the leader 4*a* is located at one side and the next-following portion 4*c* is located at the other side of the opened slot. The section 3*b* is then permitted to reassume its flat shape and the leader 4*a* is pulled downwardly (as seen in FIG. 1 or 3) while the portion 4*c* is held against penetration into the slot 3*c*. This causes the twin tips of the protuberances 3*f*, 3*f'* to penetrate into and through the web 4 in the region where the leader 4*a* is integral with the portion 4*c* and to establish a reliable form-locking connection between the web and the section 3*c*. The tips of the protuberances 3*d*, 3*e* extend into the recesses or sockets of the respective protuberances 3*f*, 3*f'* to further reduce the likelihood of accidental separation of the web 4 from the section 3*b*. As mentioned above, the length of the leader 4*a* need not exceed one-third of the width of the web 4; such relatively short leader is acceptable because of the establishment of a form-locking connection between the web 4 and the section 3*b*. The angle alpha between the folded-over leader 4*a* and the portion 4*c* of the web 4 can be a relatively small acute angle; in fact, the angle alpha can equal or approximate 0°. In other words, the freshly folded-over leader 4*a* can be adjacent one major surface and the portion 4*c* can be adjacent the other major surface of the section 3*b*. However, when the web 4 is in the process of being entrained by the conveyor 1, especially along arcuate portions of the endless path for the conveyor, the leader 4*a* normally exhibits a tendency to move away from the respective major surface of the section 3*b* and to assume a position coinciding with or close to that which is shown in FIG. 3 by broken lines, as at 4*a*'. This is desirable and advantageous because the pocket P between the leader 4*a* and the portion 4*c* of the web 4 is then fully open and is incapable of retaining a substantial quantity of liquid when it emerges from a liquid bath. Thus, and if the last liquid bath is a water bath which is followed by a heating chamber, each and every droplet of water which adheres to the inner side of the folded or partially folded leader 4*a* and/or to the inner side of the portion 4*c* of the web 4 is caused to evaporate before the web 4 is wound onto a reel or spool at a station following the developing machine.

FIG. 2 shows the section 803*b* of a conventional clamp 803. This section has a slot 803*c* but is devoid of protuberances corresponding to those shown at 3*d*, 3*e*, 3*f* and 3*f*' on the section 3*b* of FIG. 1. Therefore, and in order to prevent the web 4 from slipping relative to the section 803*b* while the latter advances in the direction of arrow 2, the entire clip 803 is turned at least once about an axis which extends at right angles to the plane of FIG. 2 and longitudinally of the slot 803*c* so that the leader 4*a* and the portion 4*c* are located at the same side of the section 803*b* and define a practically closed pocket P' which is much more likely to retain a substantial quantity of liquid than the practically open pocket P of FIG. 3. In other words, whereas the conventional method of separably attaching a web 4 to a standard clip (such as the clip 803 of FIG. 2) involves pressing the leader 4*a* against one major surface of the section 803*b* by the next-following portion 4*c* of the web, the novel method which can be practiced with the clip 3 of FIGS. 1 and 3 necessitates a simple folding of a short leader 4*a* along one major surface of the section 3*b* while the next-following portion 4*c* remains adjacent the other major surface so that it cannot overlie the leader 4*a* and cannot press the leader against the section 3*b*. This ensures that the pocket P remains open and opens even more when the section 3*b* is caused to advance in the direction of arrow 2. The reason is that the section 3*b* is provided with the means (protuberances 3*d*, 3*e*, 3*f*, 3*f*') for form-lockingly connecting at least one of the parts which flank the slot 3*c* with the web 4 immediately behind the leader 4*a*. The outflow of liquid from the pocket P of FIG. 3 is enhanced if the web 4 is caused to move upwardly (arrow 2) on its way from the last bath (such as the aforementioned rinsing bath) into and through the drying chamber. Any liquid which has entered the pocket P in the last bath is then compelled to flow downwardly along and beyond the portion 4*c* of the web 4 and is subjected to a very pronounced drying action during travel through the heating chamber. The likelihood of escape of liquid from the pocket P is further enhanced due to the fact that the leader 4*a* and the portion 4*c* of the web 4 which is shown in FIG. 3 have much greater freedom of movement relative to the section 3*b* and/or vice versa than the leader 4*a* and portion 4*c* of the web 4 which is shown in FIG. 2; such movement of the web and section 3*b* relative to each other promotes the flow of liquid out of the pocket P.

A comparison of the section 803*b* and web 4 of FIG. 2 with the section 3*b* and web 4 of FIG. 3 indicates that the total area of contact between the pocket P and the liquid in such pocket is a fraction of the total area of contact between liquid and the pocket P'. This is due to the fact that the pocket P' is closed. Moreover, liquid can also penetrate between the portion 4*c* and leader 4*a* of the web 4 which is shown in FIG. 2, especially if the pull upon the section 803*b* in the direction of arrow 2 is relaxed or terminated.

The form-locking connection of FIGS. 1 and 3 can be modified in a number of ways without departing from the spirit of the invention.

For example, the protuberances 3*f*, 3*f*' can be provided on the upper part of the section 3*b* and the protuberances 3*d*, 3*e* are then provided on the lower part. Furthermore, the protuberance 3*d* can be provided on the lower part and the complementary protuberance 3*f* can be provided on the upper part of the section 3*b*. Still further, the form-locking connection can comprise a single pair of protuberances (e.g., the protuberances 3*d*, 3*f*) or three or more pairs of protuberances. If the form-locking connection comprises at least two pairs of protuberances, one of these pairs is nearer one end of the slot 3*c* and the other pair is nearer the other end of the slot. The distance between a pair of such protuberances and the nearest end of the slot can be in the range of one-fourth to one-third of the overall length of the slot. Such spacing of pairs of complementary protuberances from each other and from the ends of the slot 3*c* ensures more uniform distribution of stresses upon the leader 4*a* of the web 4 in planes which are spaced apart from and extend longitudinally of the marginal portions of the web.

Figure 4:
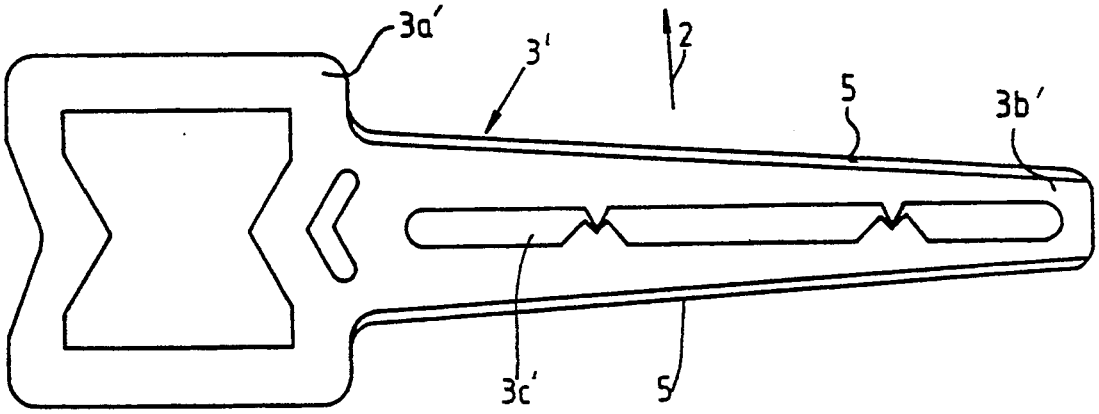
FIG. 4 is an elevational view of another motion transmitting device wherein the flat arm-shaped second section is provided with two relatively sharp edges and its width increases in a direction toward the first section.

FIG. 4 shows a modified clip 3' having a first section 3*a*' which is or can be identical with the section 3*a* of the slip 3, and a second section 3*b*' in the form of a flat arm having a width which increases gradually in a direction toward the section 3*a*'. This second section 3*b*' consists of two mirror symmetrical parts which flank the slot 3*c*'. The configuration of protuberances forming part of the form-locking connection for a web (not shown in FIG. 4) is or can be the same as that of the protuberances 3*d*, 3*e*, 3*f*, 3*f*' in the embodiment of FIGS. 1 and 3. The edge faces 5 of the section 3*b*' are inclined with reference to the slot 3*c*' to promote the flow of liquid therealong if the clip 3' is caused to move in the direction of arrow 2. The rate at which the width of the section 3*b*' increases toward the section 3*a*' is selected in such a way that the mechanical strength of the narrowest portion (remotest from the section 3*a*') still suffices to ensure the integrity of the clip 3'. Each edge face 5 defines with one of the adjacent major surfaces a sharp or relatively sharp edge which also contributes to the flow of liquid droplets from the section 3*b*'.

Figure 5:
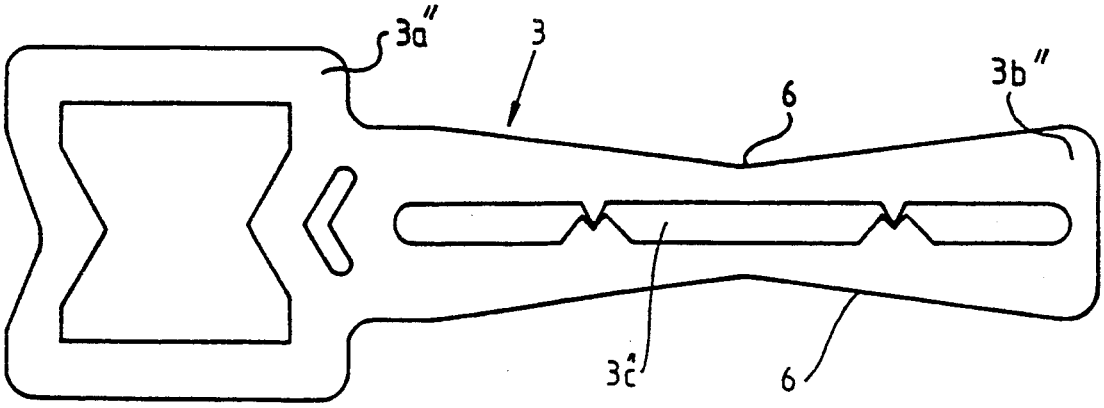
FIG. 5 is a similar elevational view of a further motion transmitting device wherein the width of the second section increases in part toward and in part away from the first section.

A further clip 3'' is shown in FIG. 5. The section 3*a*'' is or can be identical with the section 3*a* or 3*a*', and the section 3*b*'' is a modified version of the section 3*b*'. Thus, the section 3*b*'' includes a first (right-hand) portion the width of which decreases in a direction toward the section 3*a*'', and a second portion the width of which increases in a direction toward the section 3*a*''. Thus, the flat-arm like section 3*b*'' includes a narrowest portion substantially midway between the ends of its slot 3*c*''. The edge faces 6 of the section 3*b*'' may but need not define sharp edges. It has been found that the section 3*b*'' also promotes separation of liquid droplets. An advantage of the section 3*b*'' over the section 3*b*' is that its minimum width need not be less than the minimum width of the section 3b' but the inclination of the two halves of each edge face 6 relative to the slot 3c'' is much more pronounced than the inclination of edge faces 5 relative to the slot 3c'.

The distribution of protuberances which constitute the form-locking connection on the section 3b'' is or can be the same as that of protuberances 3d, 3e, 3f and 3f' on the section 3b of the clip 3 of FIGS. 1 and 3. If the webs 4 are rather narrow, it often suffices to provide a single protuberance or a single pair of protuberances substantially midway between the ends of the slot. If the webs are wide, the form-locking connection can include three pairs of protuberances. One pair of three pairs of protuberances can be located midway between the ends of the slot and the other two pairs can be placed rather close to the respective ends of the slot, e.g., at distances less than one-fourth of the overall length of the slot.

Figure 6:
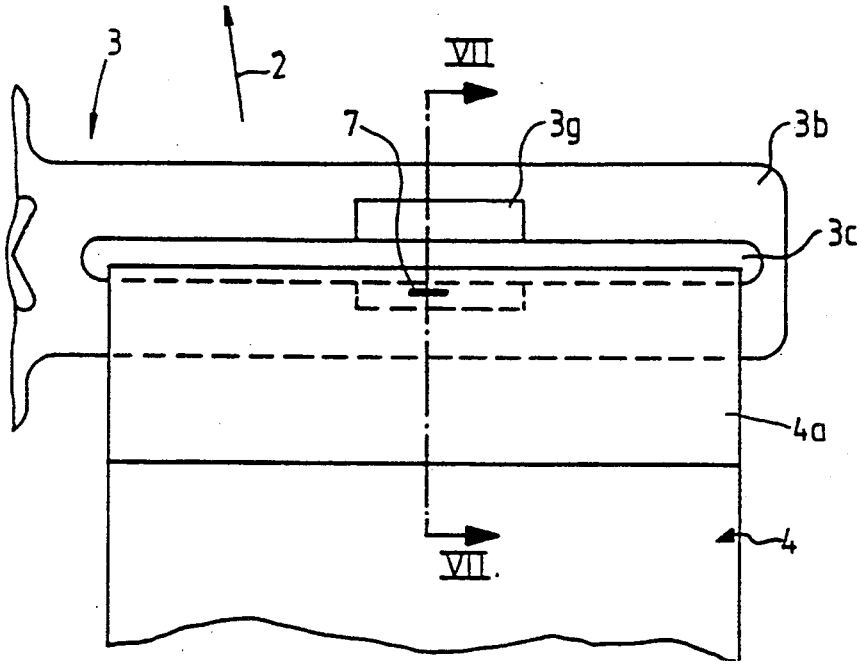
FIG. 6 is a fragmentary elevational view of an additional motion transmitting device wherein the leader is clamped to the next-following portion of the web.
Figure 7:
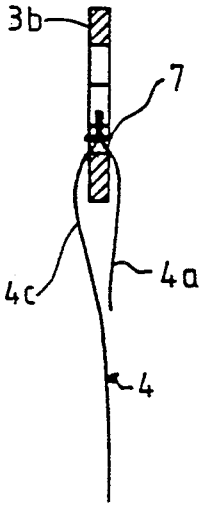
FIG. 7 is a sectional view substantially as seen in the direction of arrows from the line VII—VII of FIG. 6.

FIGS. 6 and 7 show a portion of a modified clip 3 which is or can be identical with the clip 3 of FIGS. 1 and 3 except that the section 3b does not have any integral protuberances which would be capable of establishing a form-locking connection with the web 4. Instead, the means for establishing a form-locking connection includes a clamp 7 which directly connects the leader 4a to the next-following portion 4c of the web 4. In order to facilitate the application of the clamp 7, the section 3b is provided with a window 3g including a first half in the upper part and a second half in the lower part of the section 3b. The window 3g communicates with the median portion of the slot 3c. The clamp 7 ensures that the median portions of the leader 4a and next-following portion 4c are affixed to each other in or close to the region where the web 4 is folded between 4a and 4c. The illustrated window 3g has a rectangular outline. It is possible to omit the upper half of the window 3g above the slot 3c in order to enhance the mechanical stability of the section 3b. The window 3g can be formed by removing material from the section 3b subsequent to hardening of the plastic material of the clip 3. Alternatively, the window 3g can be formed during making of the clip 3 in an injection molding or other suitable machine. It has been found that a single clamp 7 normally suffices to prevent separation of the web 4 from the section 3b. When the clip 3 of FIGS. 6 and 7 is advanced in the direction of arrow 2, the lower part of the section 3b bears against the leader 4a and portion 4c in the region of the clamp 7 and thereby further opens the already open pocket of the web in the region of the slot 3c to even more reliably ensure the establishment of a wide path for convenient evacuation of liquid from such pocket when the leader 4a and portion 4c of the web 4 leave the last liquid bath in a developing or like machine wherein webs of flexible material must be conveyed through one or more liquid baths and should be relieved of liquid after they leave the last bath. As a rule, the major part of liquid which has entered the pocket between the leader 4a and portion 4c of the web 4 of FIGS. 6 and 7 leaves the pocket as soon as the pocket advances beyond a single liquid bath or beyond the last of a plurality of successive liquid baths.

Figure 8:
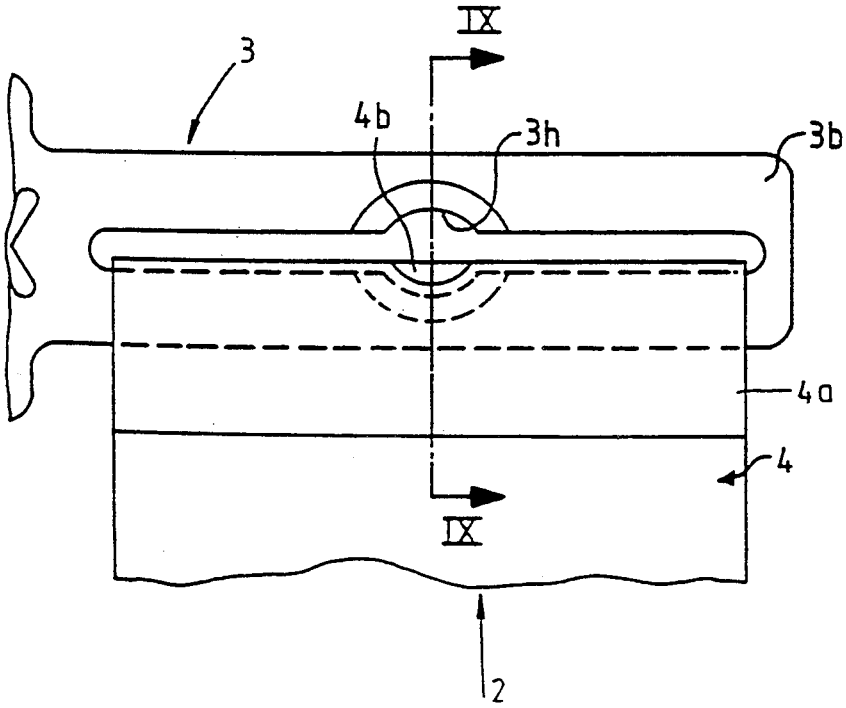
FIG. 8 is a fragmentary elevational view of still another motion transmitting device wherein the leader is bonded to the next-following portion of the web.
Figure 9:
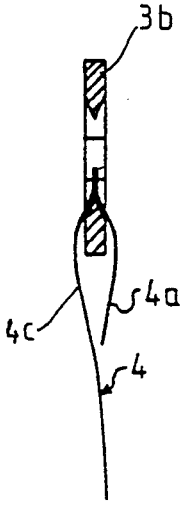
FIG. 9 is a sectional view substantially as seen in the direction of arrows from the line IX—IX of FIG. 8.

FIGS. 8 and 9 show a portion of a further clip 3 which constitutes a slight modification of the clip 3 of FIGS. 6 and 7. The difference is that the section 3b of PIGS, 8 and 9 is formed with a substantially circular or slightly oval window 3h which preferably includes two mirror symmetrical halves, one in the upper part and the other in the lower part of the section 3b. The clamp 7 of FIGS. 6 and 7 is not needed because a form-locking connection between the section 3b and the web 4 is established by directly bonding (e.g., welding) the leader 4a to the next-following portion 4c, as at 4b, i.e., within the confines of the window 3h. The web 4 of FIGS. 8 and 9, or at least that part of the web which includes the leader 4a and the portion 4c, is coated with a film of plastic material which can be welded in response to the application of pressure and/or heat to form the connection 4b. The latter has a substantially semicircular outline and can be formed by resorting to a heated tool having a head the outline of which matches the desired outline of the connection 4b. The lower part of the section 4b of FIGS. 8 and 9 can be provided with a rather sharp edge which bounds the lower portion of the slot 3a and extends into the pronounced fold between the leader 4a and the portion 4c of the web 4. Such relatively sharp edge can be provided adjacent the connection 4b (i.e., at both sides of such connection) or all the way along the entire slot 3c. The provision of a relatively sharp edge is desirable and advantageous because it reduces the likelihood of abrupt changes of stresses upon the web 4 in the regions at both sides of the connection 4b when the section 3b is advanced in the direction of arrow 2. Those portions of the folded web 4 which flank the connection 4b are substantially roof-shaped with a small angle between the respective parts of the leader 4a and portion 4c.

As mentioned above, the improved clip can be made of a suitable flexible plastic material in an injection molding or like machine. It is equally possible to make the clip of metallic sheet material, e.g., in a stamping machine. The making of pyramidal protuberances 3d, 3e, 3f, 3f' and/or similar protuberances is more difficult if the clip is made of metallic sheet stock; however, a metallic clip can be made of relatively thin sheet material so that the protuberances are sufficiently sharp to readily penetrate through a paper web or through a plastic-coated paper web even if they do not exhibit a pronounced pyramidal shape.

The clamp 7 of FIGS. 6–7 and the welded connection 4b of FIGS. 8–9 ensure that, when the clip 3 advances through a liquid bath, the leader 4a of the web 4 invariably makes only an acute angle with the next-following portion 4c. This, in turn, ensures that the web 4 cannot become separated from the clip 3, even when the web is not under tension, because the fold line between the leader 4a and the next-following portion 4c of the web 4 then abuts the edge face bounding the upper part of the slot 3c of FIGS. 6–9. Nevertheless, and since the leader 4a is inclined with reference to the portion 4c and the adjacent part of the section 3b, any liquid which happens to be entrained by the section 3b and web 4 is free to escape as soon as the clip 3 emerges from a liquid bath.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. A method of separably affixing a flexible web which has a leader to a one-piece motion transmitting arm having a slot and forming part of a clip which is adapted to be connected to a conveyor, comprising the steps of inserting the web into the slot of the arm so that the leader is located at one side and a portion of the web which is immediately adjacent and of one piece with the leader is located at the other side of the slot; folding the web in the region of the slot so that the leader and the portion which is immediately adjacent and of one piece with the leader of the web make with each other an angle of less than 90°; and establishing a form-locking connection between the web and the arm in the region of the slot.

2. The method of claim 1, wherein said angle is or approximates 0°.

3. The method of claim 1 of separably affixing the leader of an elongated flexible web having a predetermined width, wherein said folding step includes folding a leader having a length which at most equals half said predetermined width.

4. A method of separably affixing a flexible web having a leader to a one-piece motion transmitting arm having a slot and forming part of a clip which is adapted to be connected to a conveyor, comprising the steps of inserting the web into the slot of the arm so that the leader and a portion of the web which is immediately adjacent and of one piece with the leader are located at opposite sides of the slot; folding the web in the region of the slot so that the leader and the portion which is immediately adjacent and of one piece with the leader of the web define a single open pocket extending longitudinally of the slot; and establishing a form-locking connection between the web and the arm in the region of the slot.

5. A method of separably affixing a flexible web which has a leader to a motion transmitting arm having a slot and forming part of a clip which is adapted to be connected to a conveyor, comprising the steps of inserting the web into the slot of the arm so that the leader is located at one side and a portion of the web which is adjacent the leader is located at the other side of the slot; folding the web in the region of the slot so that the leader and the portion which is adjacent the leader of the web make with each other an angle of less than 90°; and establishing a form-locking connection between the web and the arm in the region of the slot, including attaching the leader to the portion which is adjacent the leader of the web at least close to the slot.

6. The method of claim 5, further comprising the step of providing the arm with a window which communicates with the slot, said attaching step including fixedly securing the leader to the portion which is adjacent the leader of the web within the window.

7. The method of claim 5, wherein said attaching step includes clamping the leader to the portion which is adjacent the leader of the web.

8. The method of claim 5, wherein said attaching step includes bonding the leader to the portion which is adjacent the leader of the web.

9. A method of separably affixing a flexible web which has a leader to a motion transmitting arm having a slot and forming part of a clip which is adapted to be connected to a conveyor, comprising the steps of inserting the web into the slot of the arm so that the leader is located at one side and a portion of the web which is adjacent the leader is located at the other side of the slot; folding the web in the region of the slot so that the leader and the portion which is adjacent the leader of the web make with each other an angle of less than 90°; and establishing a form-locking connection between the web and the arm in the region of the slot, including providing the arm with at least one protuberance at the slot and effecting penetration of the protuberance into the web in the region where the leader is flexed relative to the portion which is adjacent the leader of the web.

10. A method of separably affixing a flexible web which has a leader to a motion transmitting arm having a slot and forming part of a clip which is adapted to be connected to a conveyor, comprising the steps of inserting the web into the slot of the arm so that the leader is located at one side and a portion of the web which is adjacent the leader is located at the other side of the slot; folding the web in the region of the slot so that the leader and the portion which is adjacent the leader of the web make with each other an angle of less than 90°; and establishing a form-locking connection between the web and the arm in the region of the slot, comprising providing the arm with at least one pair of complementary protuberances which extend transversely of the slot and effecting penetration of at least one protuberance into and through the web in the region where the leader is flexed relative to the portion which is adjacent the leader of the web.

11. A device for transmitting motion from a conveyor to a flexible web having a leader, comprising a first section adapted to be separably connected with the conveyor, and a second section having an elongated slot arranged to receive a web so that the leader is located at one side and a portion of the web which is adjacent the leader is located at the other side of the slot and makes with the leader an angle of less than 90°; and means for form-lockingly connecting the web to the second section in the region of the slot, comprising at least one protuberance provided on said second section and extending transversely of said slot to penetrate into the web in the region where the leader is integral with the portion which is adjacent the leader of the web.

12. A device for transmitting motion from a conveyor to a flexible web having a leader, comprising a first section adapted to be separably connected with the conveyor, and a second section having an elongated slot arranged to receive a web so that the leader is located at one side and a portion of the web which is adjacent the leader is located at the other side of the slot and makes with the leader an angle of less than 90°; and means for form-lockingly connecting the web to the second section in the region of the slot, comprising at least one pair of complementary protuberances provided on said second section, disposed opposite each other and extending transversely of said slot so as to penetrate into and through the web in the region where the leader is integral with the portion which is adjacent the leader of the web.

13. The device of claim 12, wherein at least one protuberance of said pair is a pyramid having a tip and the other protuberance of said pair has a socket for said tip.

14. The device of claim 12, wherein said connecting means comprises two pairs of protuberances and said slot has two ends and a predetermined length, each of said pairs being nearer a different end of said slot.

15. The device of claim 14, wherein each of said pairs is spaced apart from the respective end of said slot a distance between substantially one-fourth and one-third of said predetermined length.

16. A device for transmitting motion from a conveyor to a flexible web having a leader, comprising a first section adapted to be separably connected with the conveyor, and a second section having an elongated slot arranged to receive a web so that the leader is located at one side and a portion of the web which is adjacent the leader is located at the other side of the slot and makes with the leader an angle of less than 90°, said second section further having a window which communicates with said slot; and means for form-lockingly connecting the web to the second section in the region of the slot, including means for attaching the leader to the portion which is adjacent the leader of the web at said window.

17. The device of claim 16, wherein said second section includes a first part and a second part and said slot is located between said parts, said window having a first portion in one of said parts and a second portion in the other of said parts.

* * * * *